US007216610B2

(12) United States Patent
Dunkle

(10) Patent No.: US 7,216,610 B2
(45) Date of Patent: May 15, 2007

(54) PRESSURE REGULATOR FOR ENGINE COOLING SYSTEM

(75) Inventor: Gary Lee Dunkle, Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 259 days.

(21) Appl. No.: 10/903,358

(22) Filed: Jul. 30, 2004

(65) Prior Publication Data

US 2005/0045631 A1 Mar. 3, 2005

Related U.S. Application Data

(60) Provisional application No. 60/491,704, filed on Aug. 1, 2003.

(51) Int. Cl.
*F01P 3/22* (2006.01)

(52) U.S. Cl. ..... 123/41.54; 165/104.32

(58) Field of Classification Search ..... 123/41.54; 165/104.32

See application file for complete search history.

(56) References Cited

U.S. PATENT DOCUMENTS

| | | | | |
|---|---|---|---|---|
| 4,130,159 | A * | 12/1978 | Ohta et al. | 123/41.54 |
| 4,723,596 | A * | 2/1988 | Spindelboeck et al. | 123/41.54 |
| 5,114,035 | A | 5/1992 | Brown | |
| 6,056,139 | A * | 5/2000 | Gericke | 220/203.06 |
| 6,276,312 | B1 | 8/2001 | Summan et al. | |
| 6,718,916 | B2 * | 4/2004 | Hewkin | 123/41.54 |

* cited by examiner

*Primary Examiner*—Noah P. Kamen
(74) *Attorney, Agent, or Firm*—Barnes & Thornburg LLP

(57) ABSTRACT

A cooling system apparatus includes a coolant tank, an overflow tank coupled to the coolant tank, and a pressure regulator. The pressure regulator regulates flow of fluid discharged from the coolant tank into the overflow tank.

26 Claims, 6 Drawing Sheets

PRESSURE REGULATOR FOR ENGINE COOLING SYSTEM

This application claims priority under 35 U.S.C. § 119(e) to U.S. Provisional Application Ser. No. 60/491,704, filed Aug. 1, 2003, which is expressly incorporated by reference herein.

BACKGROUND

The present disclosure relates to cooling systems for engines, and particularly to cooling systems with coolant overflow tanks. More particularly, the present disclosure relates to pressure-relief valves in cooling system closures.

SUMMARY

In accordance with the present disclosure, a cooling system apparatus includes a coolant tank, an overflow tank arranged to receive fluid discharged from the coolant tank, and a pressure regulator. The pressure regulator is arranged to extend into the overflow tank normally to block flow of fluid between the coolant and the overflow tanks.

In illustrative embodiments, the pressure regulator includes a pressure-relief valve member and a biasing spring arranged normally to apply a biasing force to urge the pressure-relief valve member to assume a closed position. The pressure-relief valve and the biasing spring are located in the overflow tank. In certain embodiments, the biasing spring can be compressed to assume a predetermined state.

Also in illustrative embodiments, a compression controller is associated with the biasing spring. The compression controller is coupled to the overflow tank and configured to vary the biasing force applied by the biasing spring to the pressure-relief valve member.

An operator can use the compression controller to vary a "closure" force (e.g., the biasing force of the biasing spring) applied to maintain the pressure-relief valve member in a normally closed position. The compression controller can be mounted for rotary, linear, and/or other suitable movement relative to the overflow tank to change the biasing force of the biasing spring.

An operator can select a "lower" closure force by moving the compression controller relative to the overflow tank to "decompress" (i.e., relax) the biasing spring. In the case of a lower closure force, fluid extant in the extant tank can have a relatively low-pressure level and still "move" the pressure-relief valve member against the biasing spring to assume an opened position.

An operator can select a "higher" closure force by moving the compression controller relative to the overflow tank to "compress" (i.e., squeeze) the biasing spring. In the case of a higher closure force, fluid extant in the coolant tank must have a relatively higher pressure level to move the pressure-relief valve member against the biasing spring to assume an opened position.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
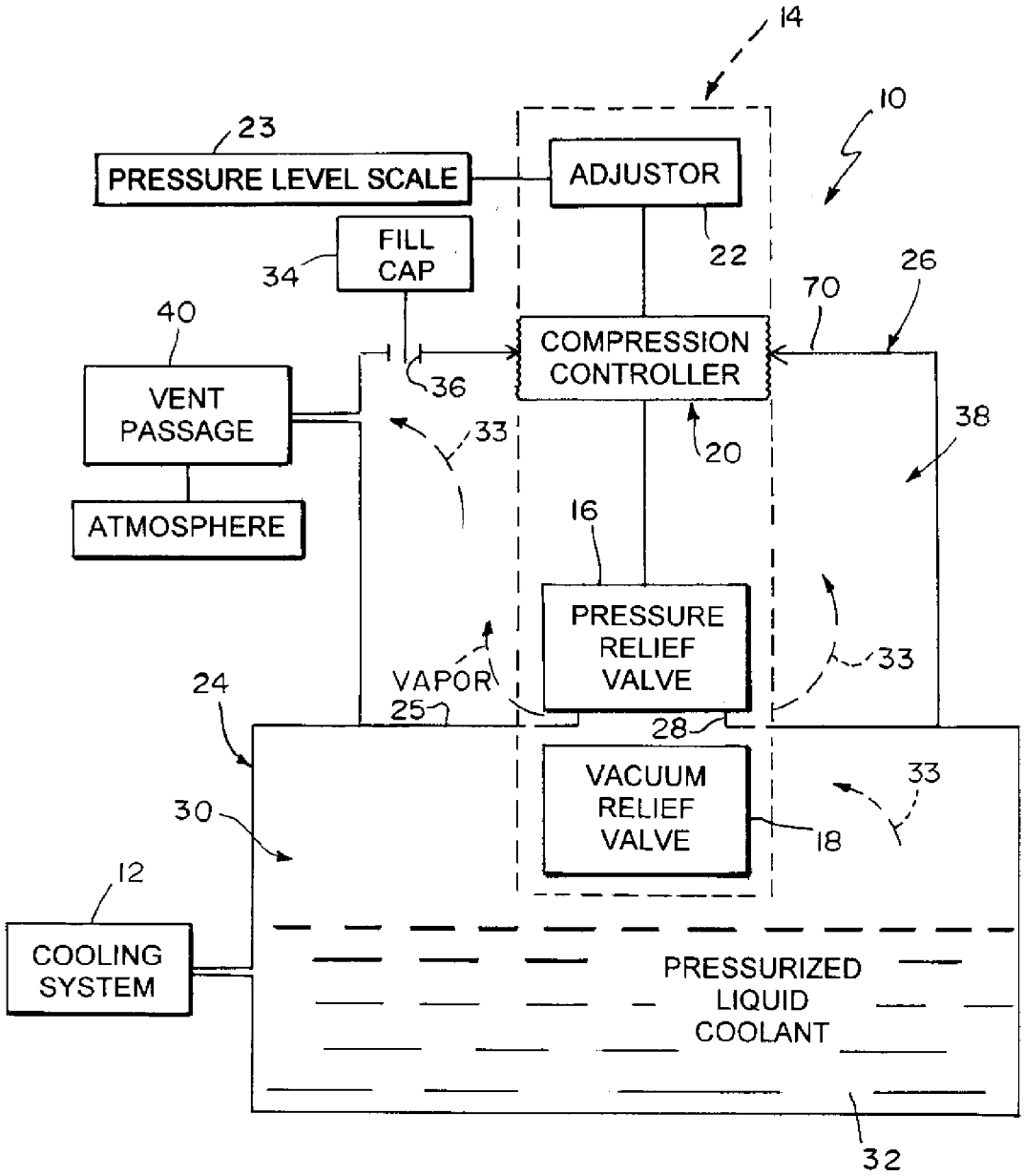
FIG. 1 is a diagrammatic view of a degas bottle for an engine cooling system in accordance with the present disclosure.

A degas bottle or cooling system apparatus 10 is adapted to be coupled to an engine cooling system 12 as suggested diagrammatically in FIG. 1. One typical function of a degas bottle is to remove air from a coolant system.

A pressure regulator 14 in accordance with the present disclosure is included in degas bottle 10 as suggested diagrammatically in FIG. 1 and illustratively in FIGS. 2–5. Pressure regulator 14 includes a pressure-relief valve 16, a vacuum-relief valve 18, a compression controller 20, and an adjustor 22. It is also within the scope of this disclosure to couple pressure regulator 14 to a radiator cap (not shown). In another embodiment illustrated in FIG. 6, compression controller 20 and adjustor 22 are omitted to provide a non-adjustable pressure regulator 14' in degas bottle 10'.

Degas bottle 10 also includes a coolant tank 24 coupled to cooling system and an overflow tank 26 coupled to coolant tank 24 through a passageway 28. Coolant tank 24 is formed to include an interior region 30 containing a pressurized liquid coolant 32. Pressure regulator 14 is configured normally to close passageway 28 to block flow of a fluid such as liquid, vapor, and/or air between coolant tank 24 and overflow tank 26 via passageway 28.

In the illustrative embodiment, a fill cap 34 is provided normally to close an inlet 36 that is configured to open into an interior region 38 of overflow tank 26 to allow users to admit liquid coolant 32 into interior region 38 of overflow tank 26. A vent passage 40 is provided to conduct vapor and/or air to the atmosphere from overflow tank 26. Although overflow tank 26 normally is mounted on and coupled to coolant tank 24 to form two liquid reservoirs in degas bottle 10 as suggested in FIG. 1, it is within the scope of this disclosure to position overflow tank 26 in spaced-apart relation to coolant tank 24 and use a hose (not shown) to define passageway 28.

As suggested in FIG. 1, compression controller 20 is used to vary a biasing or "closure" force applied to maintain pressure-relief valve 16 in a normally closed position. Adjustor 22 is coupled to compression controller 20 and used by a technician to operate compression controller 20 to vary the closure force applied to pressure-relief valve 16. By selecting a "lower" biasing or closure force, pressurized liquid coolant 32 and/or vapor 33 will vent from interior region 30 of coolant tank 24 into interior region 38 of overflow tank 26 through passageway 28 at a first tank pressure level. By selecting a relatively "higher" biasing or closure force, as suggested, for example, in FIG. 3, pressurized liquid coolant 32 and/or vapor 33 will vent from interior region 30 into interior region 38 through passageway 28 at a greater second tank pressure level.

Using adjustor 22 it is possible for a technician to vary the maximum pressure level that will normally exist in interior region 30 of coolant tank 24 (and in cooling system 12) quickly and easily. It is within the scope of this disclosure to provide a "pressure-level" scale 23 associated with adjustor 22 (as suggested in FIG. 1) to provide a visual signal to the technician of the tank pressure level established by compression controller 20 using adjustor 22.

Vacuum-relief valve 18 is configured to move to an opened position allowing liquid and vapor and air to flow from interior region 38 of overflow tank 26 into interior region 30 of coolant tank 24 whenever the tank pressure level in interior region 30 falls below a predetermined level. Vacuum-relief valve 18 normally is moved to assume a closed position, yet is configured to move to an opened position (in the manner described herein) regardless of the pressure-relief valve biasing or closure force established by compression controller 20.

One illustrative embodiment of degas bottle 10 and pressure regulator 14 included in degas bottle 10 is shown in FIGS. 2–5 in various modes of operation. Pressure-relief valve 16 comprises a pressure-relief valve member 50 and a biasing spring 52. Vacuum-relief valve 18 comprises a vacuum-relief valve member 54 and a biasing spring 56.

Compression controller 20 includes a spring mount 58 coupled to an outer end 60 of biasing spring 52 and a drive shaft 62 extending in an outward direction from spring mount 58 to mate with adjustor 22. An inner end 61 of biasing spring 52 is coupled to pressure-relief valve member 50 as shown, for example, in FIG. 2.

Drive shaft 62 is received for rotation (or other movement) in a bore 64 formed, for example, in a ring 66 mounted in an aperture 68 formed in a top wall 70 of overflow container 26. An O-ring seal (not shown) or other suitable seal is provided to establish a liquid and/or vapor seal between each of (1) ring 66 and top wall 70 and (2) ring 66 and drive shaft 62.

External threads 63 on drive shaft 62 mate with internal threads 65 in bore 64 of ring 66 to cause drive shaft 62 to move inwardly in direction 71 in response to clockwise rotation of adjustor 22 (and drive shaft 62) about axis 72 and to cause drive shaft to move outwardly in direction 73 in response to counterclockwise rotation of adjustor 22 (and drive shaft 62) about axis 72. It is within the scope of this disclosure to use other suitable means to move drive shaft 62 in directions 71, 73 relative to overflow container 26.

Figure 2:
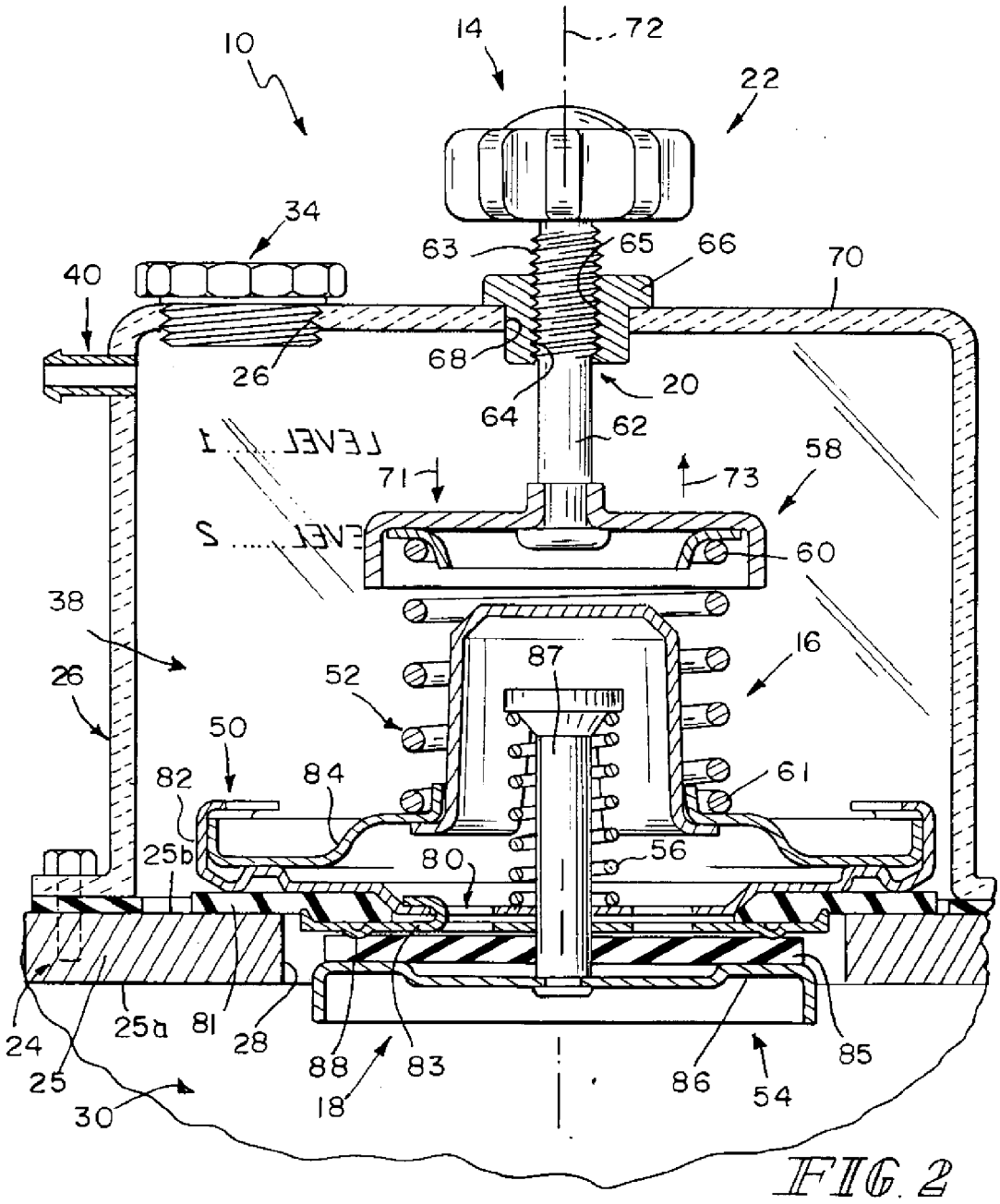
FIG. 2 is a sectional view of an illustrative embodiment of the bottle of FIG. 1 showing compression of a coiled spring to exert a downward first biasing (closure) force on a pressure-relief valve member normally closing an opening in a coolant tank.
Figure 3:
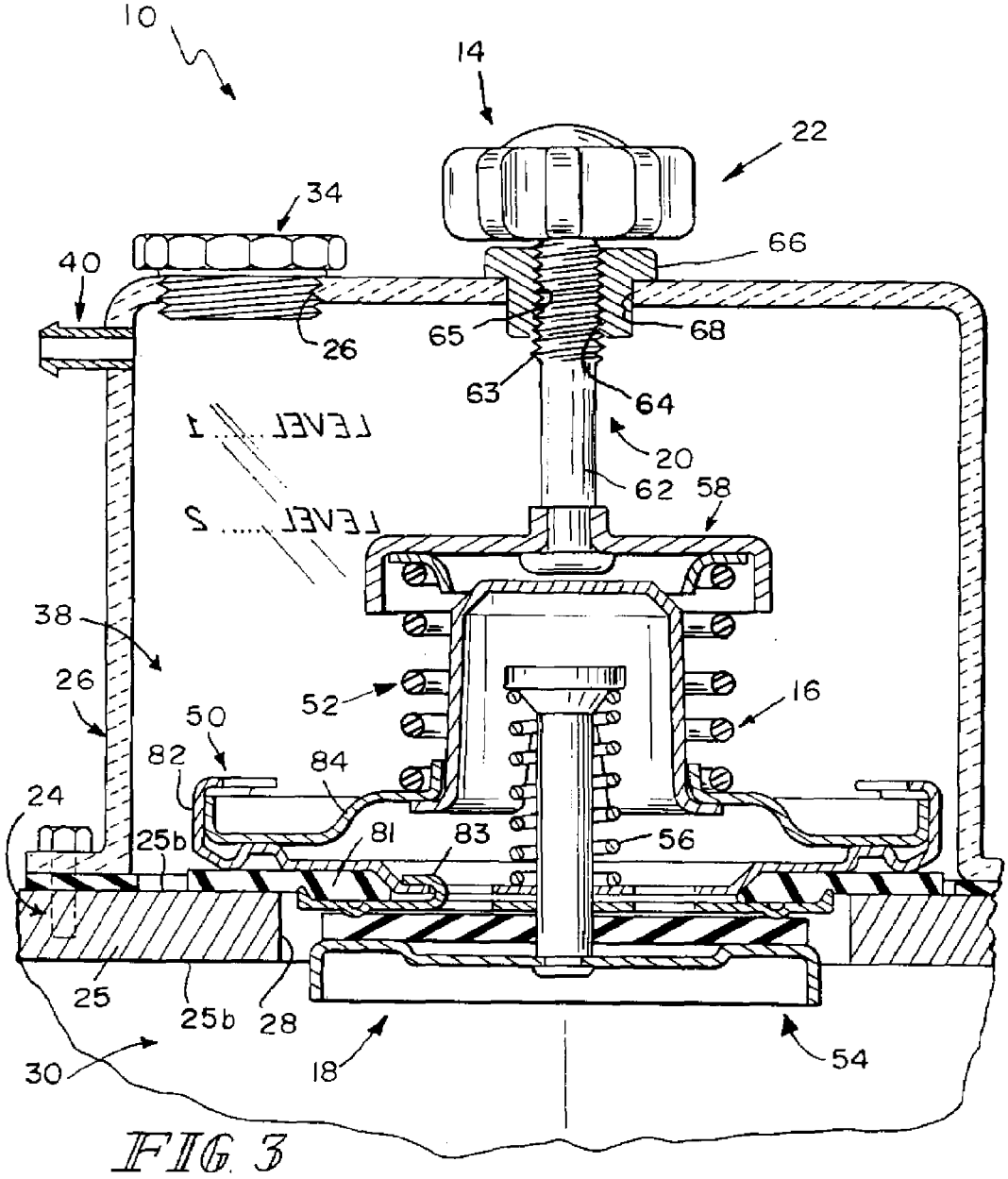
FIG. 3 is a view similar to FIG. 2 showing further compression of the coiled spring to exert a larger downward biasing (closure) force on the pressure-relief valve member.
Figure 4:
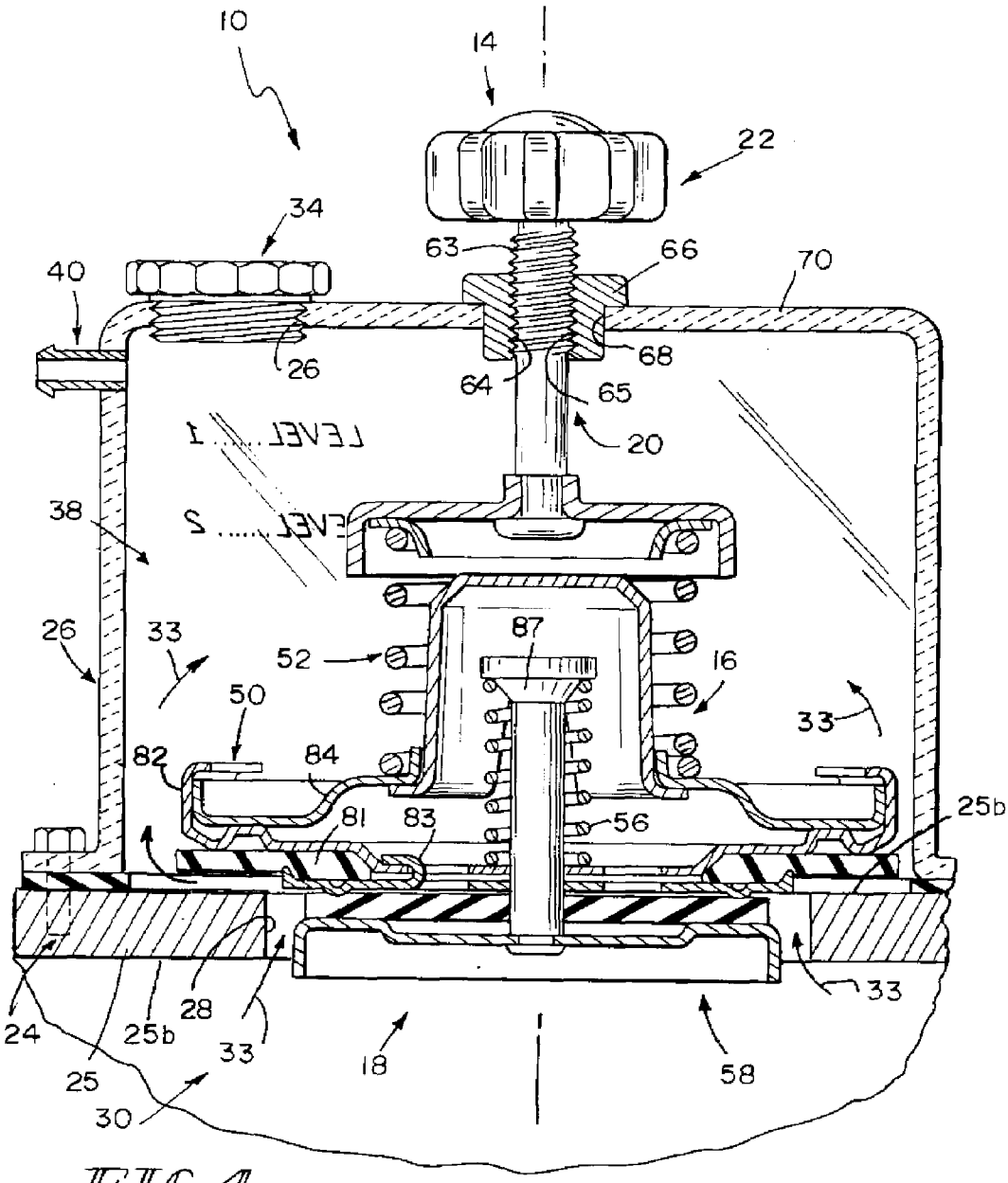
FIG. 4 is a view similar to FIGS. 2 and 3 showing movement of the pressure-relief valve member upwardly against the coiled spring to allow pressurized fluid (e.g., liquid and/or vapor) to flow from the coolant tank into the overflow tank.

The biasing or closure force applied to pressure-relief valve member 50 by biasing spring 52 is increased (i.e., greatened) when drive shaft 62 is moved in direction 71 owing to greater compression of biasing spring 52*a* suggested, for example, in FIG. 3. In contrast, the biasing or closure force applied to pressure-relief member 50 by biasing spring 52 is decreased (i.e., lessened) when drive shaft 26 is moved in direction 73 owing to lesser compression (i.e., decompression) of biasing spring 52 as suggested, for example, in FIG. 2.

In the illustrated embodiment, as suggested in FIG. 2, pressure-relief valve member 50 is formed to include a central aperture 80. Pressure-relief valve member 50 includes a seal ring 81, an outer seal plate 82, an inner seal plate 83 coupled to outer seal plate 82 to retain seal ring 81 therebetween, and a spring mount 84 coupled to outer seal plate 82 and to inner end 61 of biasing spring 52.

Coolant tank 24 includes an outer wall 25 formed to include passageway 28 therein in the illustrated embodiment. Overflow tank 26 is coupled to coolant tank 24 to cause interior region 30 of coolant tank 24 to lie on a first side 25*a* of outer wall 25 and interior region 38 of overflow tank 26 to lie on an opposite second side 25*b* of outer wall 25*a* suggested in FIG. 2.

Pressure-relief valve member 50 is moved by biasing spring 52 and compression controller 20 normally to engage second surface 25*b* of outer wall 25 of coolant tank 24 normally to close passageway 28 as shown, for example, in FIG. 2. During "high-pressure" conditions in interior region 30 of coolant tank 24 pressure-relief valve member 50 is moved away from a valve seat established on second surface 25*b* of outer wall 25 of coolant tank 24 to vent vapor 33 through passageway 28 into interior region 38 of overflow tank 26 as shown, for example, in FIG. 4.

In the illustrated embodiment, vacuum-relief valve member 54 includes a seal member 85, seal plate 86, and post 87 coupled to seal plate 86, as shown, for example, in FIG. 2. Biasing spring 56 is coupled to post 87 and to outer seal plate 82 normally to move seal member 85 to a position closing central aperture 80 formed in pressure-relief valve member 50 as shown, for example, in FIGS. 2–4. Biasing spring 56 is located in interior region 38 of overflow tank 26 and inside a space bounded by biasing spring 52.

Figure 5:
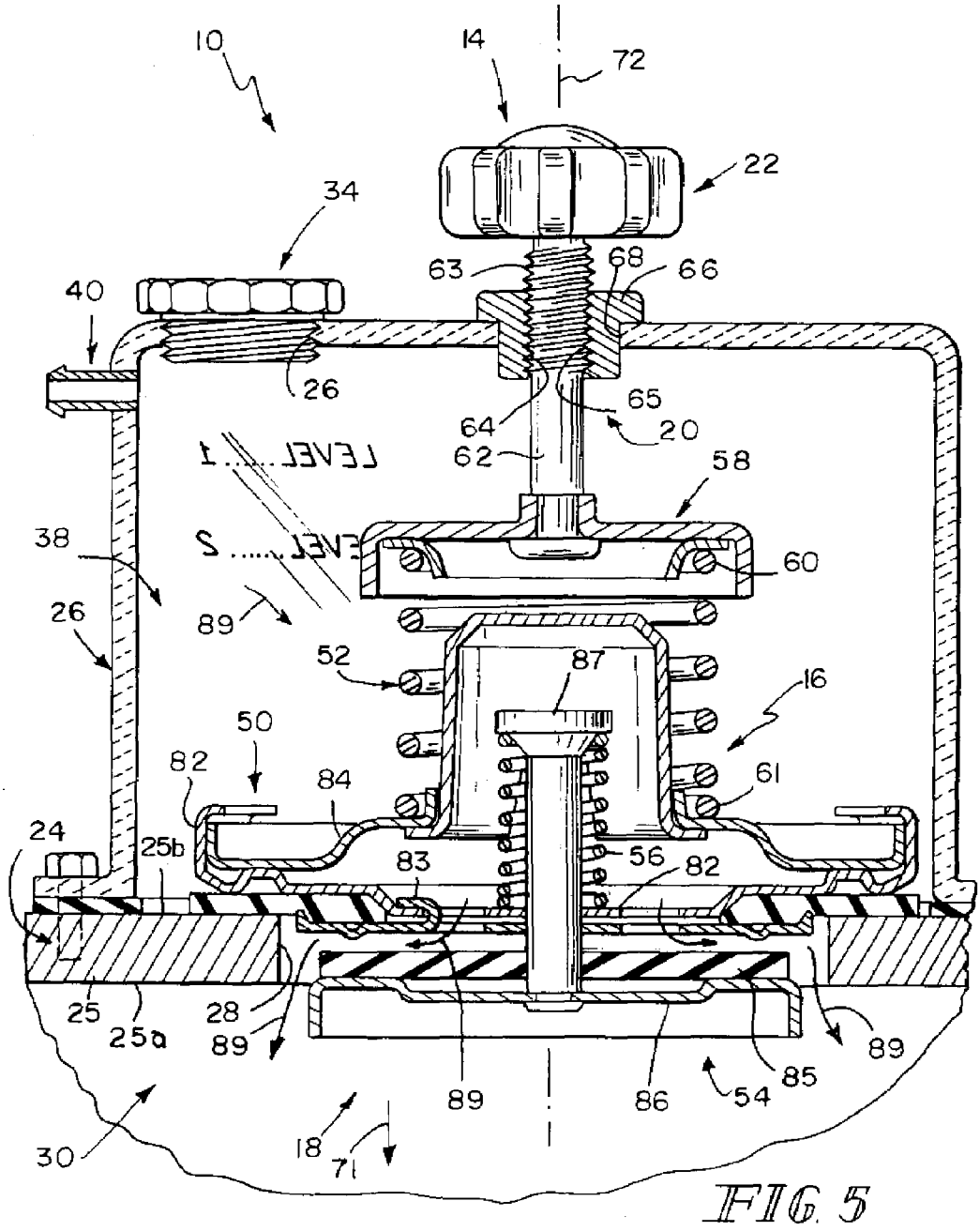
FIG. 5 is a view similar to FIGS. 2–4 showing the pressure-relief valve member in a normally closed position and movement of a vacuum-relief valve member downwardly against a biasing force provided by another coiled spring to open a central aperture formed in the pressure-relief valve member to allow fluid (e.g., liquid and/or vapor and/or air) in the overflow tank to flow through the central aperture into the coolant tank.

During "vacuum" conditions in interior region 30 of coolant tank 24, vacuum-relief member 54 will be drawn in direction 71 into interior region 30 away from an annular valve seat 88 formed on inner seal plate 83 to open central aperture 80 formed in pressure-relief valve member 50 as shown, for example, in FIG. 5. This action allows air 89 or other liquid and/or gas to flow through central aperture 80 and passageway 28 from interior region 38 of overflow tank 26 into interior region 30 of coolant tank 24 as shown in FIG. 5.

In the illustrated embodiment, pressure-relief valve member 50, biasing spring 52, and at least a portion of compression controller 20 are located in interior region 38 of overflow tank 26. As suggested in FIG. 2, an outer end 60 of biasing spring 52 engages compression controller 20 and an inner end 61 of biasing spring 52 engages pressure-relief valve member 50.

As suggested in FIGS. 2 and 3, compression controller 20 engages overflow tank 26 to permit limited movement of compression controller 20 back and forth along axis 72 associated with coiled compression spring 52. Movement of compression controller 20 along axis 72 in a first direction 71 toward coolant tank 24 compresses coiled compression spring 52. Movement of compression controller 20 along axis 72 in an opposite second direction 73 away from coolant tank 24 decompresses coiled compression spring 52.

In the illustrated embodiment, overflow tank 26 includes internal threads 64 and compression controller 20 includes external threads 63. External threads 63 are configured to mate with internal threads 64 to support compression controller 20 for rotation about and linear motion along axis 72 relative to overflow tank 26. Such rotation and motion in a first direction compresses biasing spring 52 so as to greaten the biasing or closure force applied by biasing spring 52 to maintain pressure-relief valve member 50 in the closed position. Such rotation and motion in a second direction decompresses biasing spring 52 so as to lessen the biasing or closure force applied by biasing spring 52 to maintain pressure-relief valve member 50 in the closed position.

In the illustrated embodiment, compression controller 20 includes a drive shaft 62 formed to include external threads 63. Drive shaft 62 is arranged to extend through bore 64 formed in overflow tank 26 and defined by internal threads 65. As suggested, for example, in FIG. 2, top wall 70 of overflow tank 26 is formed to include aperture 68 and overflow tank 26 includes a ring 66 mounted in aperture 68 and formed to include internal threads 65 and bore 64.

In use, compression controller 20 is engaged to overflow tank 26 to provide means for varying the biasing (closure) force applied by biasing spring 52 to either lessen or greaten the biasing force applied by biasing spring 52 to maintain pressure-relief valve member 50 in the closed position. Thus, a relatively low pressure of fluid in coolant tank 24 is sufficient to move pressure-relief valve member 50 against the biasing (closure) force of biasing spring 52 to assume an opened position allowing flow of fluid from coolant tank 24 into overflow tank 26 when compression controller 20 is operated to "decompress" biasing spring 52. In contrast, a relatively high pressure of fluid in coolant tank 24 must be extant to move pressure-relief valve member 50 against the biasing (closure) force of biasing spring 52 to assume the opened position when compression controller 20 is operated to "compress" biasing spring 52.

Reference is made to U.S. Pat. Nos. 5,114,035 and 6,276,312, which references are hereby incorporated by reference herein. These references disclose engine cooling systems and radiator caps. It is within the scope of this disclosure to couple pressure regulator 14 to a radiator cap.

Figure 6:
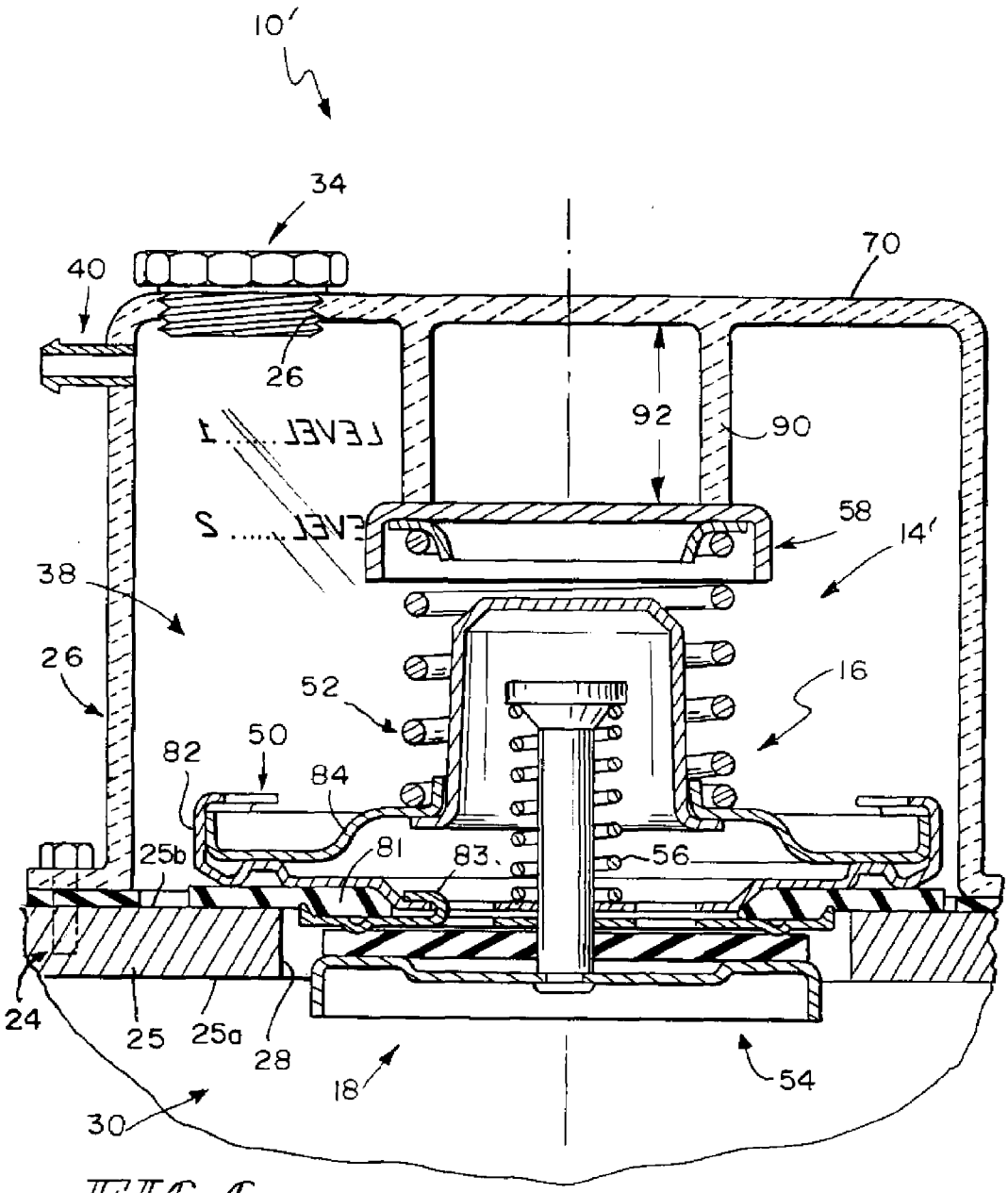
FIG. 6 is a sectional view of another illustrative embodiment of a degas bottle for an engine cooling system in accordance with the present disclosure showing a pressure-relief valve and a companion biasing spring located in an overflow tank.

A non-adjustable degas bottle 10' in accordance with another embodiment of the disclosure is shown, for example, in FIG. 6. In this embodiment, pressure-relief valve member 50 and biasing spring 52 are included in pressure regulator 14' and located in interior region 38 of overflow tank 26. A stand-off such as, for example, sleeve 90 is coupled to top wall 70 of overflow tank 26 and arranged to extend into interior region 38 to engage spring mount 58 so that biasing spring 52 is compressed to assume a predetermined state. Such a state can be determined during manufacture of degas bottle 10' by selecting a predetermined length 92 of sleeve 90. Vacuum-relief valve 18 is also included in pressure regulator 14'.

The invention claimed is:

1. A cooling system apparatus comprising a coolant tank formed to include an interior region and a passageway opening into the interior region, an overflow tank coupled to coolant tank through the passageway and formed to include an interior region communicating with the passageway, a pressure regulator arranged normally to block flow of fluid between the interior regions of the coolant and overflow tanks via the passageway, the pressure regulator including a pressure-relief valve member, a biasing spring associated with the pressure-relief valve member, and a compression controller mounted for movement relative to the overflow tank to vary biasing force applied by the biasing spring to maintain the pressure-relief valve member in a closed position blocking flow of fluid between the interior regions of the coolant and overflow tanks via the passageway, and wherein the pressure-relief valve member, biasing spring, and at least a portion of the compression controller are located in the interior region of the overflow tank.

2. The apparatus of claim 1, wherein the biasing spring is a first coiled compression spring including an inner end engaging the pressure-relief valve member and an outer end engaging the compression controller.

3. The apparatus of claim 2, wherein the compression controller engages the overflow tank to permit limited movement of the compression controller back and forth along a central axis associated with the first coiled compression spring, movement of the compression controller along the central axis in a first direction toward the coolant tank compresses the first coiled compression spring, and movement of the compression controller along the central axis in an opposite second direction away from the coolant tank decompresses the first coiled compression spring.

4. The apparatus of claim 1, wherein the pressure-relief valve member is formed to include a central aperture and the pressure regulator further includes a vacuum-relief valve member and biasing means for yieldably biasing the vacuum-relief valve member normally to a closed position closing the central aperture formed in the pressure-relief valve member.

5. The apparatus of claim 4, wherein the biasing means includes a second coiled compression spring located in the interior region of the overflow tank and inside a space bounded by the first coiled compression spring.

6. A cooling system apparatus comprising a coolant tank formed to include an interior region and a passageway opening into the intenor region, an overflow tank coupled to coolant tank through the passageway and formed to include an interior region communicating with the passageway, a pressure regulator arranged normally to block flow of fluid between the interior regions of the coolant and overflow tanks via the passageway, the pressure regulator including a pressure-relief valve member, a biasing spring associated with the pressure-relief valve member, and a compression controller mounted for movement relative to the overflow tank to vary biasing force applied by the biasing spring to maintain the pressure-relief valve member in a closed position blocking flow of fluid between the interior regions of the coolant and overflow tanks via the passageway, and wherein the overflow tank includes internal threads and the compression controller includes external threads configured to mate with the internal threads to support the compression controller for rotation about and linear motion along an axis relative to the overflow tank in a first direction to compress the biasing spring so as to greaten the biasing force applied by the biasing spring to maintain the pressure-relief valve member in the closed position and in a second direction to decompress the biasing spring so as to lessen the biasing force applied by the biasing spring to maintain the pressure-relief valve member in the closed position.

7. The apparatus of claim 6, wherein the compression controller includes a drive shaft formed to include the external threads and arranged to extend through a bore formed in the overflow tank and defined by the internal threads and a spring mount coupled to an inner portion of the drive shaft to move therewith and arranged to lie in the interior region of the overflow tank and engage the biasing spring.

8. The apparatus of claim 6, wherein the overflow tank includes a top wall formed to include an aperture and a ring mounted in the aperture and formed to include the internal threads and the bore.

9. A cooling system apparatus comprising a coolant tank formed to include an interior region and a passageway opening into the interior region, an overflow tank coupled to coolant tank through the passageway and formed to include an interior region communicating with the passageway, a pressure regulator arranged normally to block flow of fluid between the interior regions of the coolant and overflow tanks via the passageway, the pressure regulator including a pressure-relief valve member, a biasing spring associated with the pressure-relief valve member, and a compression controller mounted for movement relative to the overflow tank to vary biasing force applied by the biasing spring to maintain the pressure-relief valve member in a closed position blocking flow of fluid between the interior regions of the coolant and overflow tanks via the passageway, and wherein the coolant tank includes an outer wail formed to include the passageway therein, the overflow tank is coupled to the coolant tank to cause the interior region of the coolant tank to lie on a first side of the outer wall and the interior region of the overflow tank to lie on an opposite second side of the outer wall, and the biasing spring is located in the interior region of the overflow tank and arranged normally to apply a biasing force to urge the pressure-relief valve member to engage the opposite second side of the outer wall to block flow of fluid into the interior region of the overflow tank from the interior region of the coolant tank via the passageway.

10. The apparatus of claim 9, wherein the overflow tank includes a top wall arranged to lie in spaced-apart relation to the outer wall of the coolant tank to locate the biasing spring therebetween and the compression controller is mounted on the top wall of the overflow tank for movement along an axis in a first direction toward the outer wall of the coolant tank to increase the biasing force applied to urge the pressure-relief valve member to engage the outer wall of the coolant tank and in an opposite second direction away from the outer wall of the coolant tank to decrease the biasing force applied to urge the pressure-relief valve member to engage the outer wall of the coolant tank.

11. The apparatus of claim 10, wherein the coolant tank includes means for supporting the compression controller to rotate about the axis in a first rotary direction to cause the compression controller to move along the axis in the first direction so as to compress the biasing spring and to rotate about the axis in a second rotary direction to cause the compression controller to move along the axis in the second direction so as to decompress the biasing spring.

12. The apparatus of claim 10, wherein the top wall of the overflow tank is formed to include an aperture and includes a ring mounted in the aperture and formed to include internal threads and the compression controller includes external threads configured to mate with the internal threads of the ring to support the compression controller for rotation about the axis and liner motion along the axis.

13. The apparatus of claim 9, wherein the compression controller includes a drive shaft extending through an aperture formed in the top wall of the overflow tank and a spring mount coupled to an inner portion of the drive shaft to move therewith and arranged to lie in the interior region of the overflow tank and engage the biasing spring.

14. The apparatus of claim 13, wherein the drive shaft is arranged to mate with the top wall of the overflow tank to support the drive shaft for rotation in the aperture about the axis in a first rotary direction to cause the spring mount to move along the axis in a first direction toward the outer wall of the coolant tank to compress the biasing spring between the outer wall of the coolant tank and the spring mount so as to greaten the biasing force applied by the biasing spring to maintain the pressure-relief valve member in the closed position and in a second rotary direction to cause the spring mount to move along the axis in an opposite second direction away from the outer wall of the coolant tank to decompress the biasing spring so as to lessen the biasing force applied by the biasing spring to maintain the pressure-relief valve member in the closed position.

15. The apparatus of claim 13, wherein the top wall of the overflow tank includes a ring mounted in the aperture and formed to include internal threads and the drive shaft includes external threads configured to mate with the internal threads of the ring to support the drive shaft for rotation about the axis and linear motion along the axis.

16. A cooling system apparatus comprising a coolant tank formed to include an interior region and a passageway opening into the interior region, an overflow tank coupled to coolant tank through the passageway and formed to include an interior region communicating with the passageway, a pressure regulator arranged normally to block flow of fluid between the interior regions of the coolant and overflow tanks via the passageway, the pressure regulator including a pressure-relief valve member, a biasing spring associated with the pressure-relief valve member, and a compression controller mounted for movement relative to the overflow tank to vary biasing force applied by the biasing spring to maintain the pressure-relief valve member in a closed position blocking flow of fluid between the interior regions of the coolant and overflow tanks via the passageway, and wherein the compression controller includes a spring mount and a drive shaft coupled to the spring mount and arranged to extend away from the spring mount and through an aperture formed in the overflow tank and the biasing spring is interposed between the spring mount and the pressure-relief valve member.

17. The apparatus of claim 16, wherein the biasing spring is a coiled compression spring arranged to lie in the interior region of the overflow tank, an outer end of the coiled compression spring engages the spring mount, and an inner end of the coiled compression spring engages the pressure-relief valve member.

18. The apparatus of claim 16, wherein the overflow tank includes internal threads and the drive shaft includes external threads configured to mate with the internal threads to support the drive shaft for rotation about an axis relative to the overflow tank and linear motion along the axis to one of increase the biasing force applied by the biasing spring in response to rotation of the drive shaft in a first rotary direction about the axis and to decrease the biasing force applied by the biasing spring in response to rotation of the drive shaft in an opposite second rotary direction about the axis.

19. The apparatus of claim 18, wherein the compression controller further includes an adjustor coupled to the drive shaft and arranged to lie outside of the interior region of the overflow tank to provide means for rotating the drive shaft about the axis to vary the biasing force applied by the biasing spring so that a first pressure of fluid in the interior region of the coolant tank is sufficient to move the pressure-relief valve member against the biasing force of the biasing spring to assume an opened position allowing flow of fluid from the interior region of the coolant tank into the interior region of the overflow tank in response to rotation of the drive shaft about the axis in the first direction to assume a first position and, in response to rotation of the drive shaft about the axis in the opposite second direction to assume a second position, a greater second pressure of fluid in the interior region of the coolant tank must be extant to move the pressure-relief valve member against the biasing force of the biasing spring to assume an opened position allowing flow of fluid from the interior region of the coolant tank into the interior region of the overflow tank.

20. The apparatus of claim 18, wherein the overflow tank includes a wall formed to include the aperture and a ring mounted in the aperture and formed to include the internal threads.

21. The apparatus of claim 16, wherein the overflow tank includes a wall formed to include the aperture and a ring mounted in the aperture and formed to engage the drive shaft and govern axial movement of the drive shaft along the axis to vary the biasing force generated by the biasing spring in response to rotation of the drive shaft about the axis.

22. The apparatus of claim 21, wherein the compression controller includes an adjustor coupled to the drive shaft and arranged to lie outside of the interior region of the overflow tank and the ring is arranged to lie between the adjustor and the spring mount.

23. A cooling system apparatus comprising a coolant tank, an overflow tank arranged to receive fluid discharged from the coolant tank, a pressure-relief valve member in the overflow tank and arranged normally to assume a closed position blocking flow of fluid discharged from the coolant tank into the overflow tank, a biasing spring in the overflow tank and arranged normally to apply a biasing force to urge the pressure-relief valve member to assume the closed position, and means for varying the biasing force applied by the biasing spring to one of lessen the biasing force applied by the biasing spring to maintain the pressure-relief valve member in the closed position so that a first pressure of fluid in the coolant tank is sufficient to move the pressure-relief valve member against the biasing force of the biasing spring to assume an opened position allowing flow of fluid from the coolant tank into the overflow tank and greaten the biasing force applied by the biasing spring to maintain the pressure-relief valve member in the closed position so that a greater second pressure of fluid in the coolant tank must be extant to move the pressure-relief valve member against the biasing force of the biasing spring to assume an opened position allowing flow of fluid from the coolant tank into the overflow tank.

24. A cooling system apparatus comprising a coolant tank, an overflow tank arranged to receive fluid discharged from the coolant tank, a pressure-relief valve member arranged normally to assume a closed position blocking flow of fluid discharged from the coolant tank into the overflow tank, a biasing spring arranged normally to apply a biasing force to urge the pressure-relief valve member to assume the closed position, a drive shaft mounted for controlled movement in a bore formed in the overflow tank, and a spring mount coupled to the drive shaft, located in the overflow tank, and arranged to engage an outer end of the biasing spring to lessen the biasing force applied by the biasing spring to maintain the pressure-relief valve member in the closed position in response to movement of the drive shaft in a first direction in the bore toward the coolant tank and to greaten the biasing force applied by the biasing spring to maintain the pressure-relief valve member in the closed position in response to movement of the drive shaft in an opposite second direction in the bore away from the coolant tank.

25. A cooling system apparatus comprising a coolant tank formed to include an interior region and a passageway opening into the interior region, an overflow tank coupled to coolant tank through the passageway and formed to include an interior region communicating with the passageway, and a pressure regulator arranged normally to block flow of fluid between the interior regions of the coolant and overflow tanks via the passageway, the pressure regulator including a user accessible adjustable pressure-relief valve member and a biasing spring associated with the pressure-relief valve member, the pressure-relief valve member and biasing spring being located in the interior region of the overflow tank.

26. A cooling system apparatus comprising a coolant tank, an overflow tank arranged to receive fluid discharged from the coolant tank, the overflow tank including a top wall and a stand-off coupled to the top wall and arranged to extend into an interior region formed in the overflow tank, a pressure-relief valve member located in the interior region of the overflow tank and arranged normally to assume a closed position blocking flow of fluid discharged from the coolant tank into the overflow tank, and a biasing spring located in the interior region of the overflow tank and arranged to engage the stand-off normally to apply a biasing force to urge the pressure-relief valve member to assume the closed position.

* * * * *